US007665676B2

(12) United States Patent
Lev

(10) Patent No.: US 7,665,676 B2
(45) **Date of Patent: *Feb. 23, 2010**

(54) SHOWERHEAD SYSTEM WITH INTEGRATED HANDLE

(76) Inventor: Mordechai Lev, 6578 Torybrooke Cir., West Bloomfield, MI (US) 48323

( * ) Notice: Subject to any disclaimer, the term of this patent is extended or adjusted under 35 U.S.C. 154(b) by 0 days.

This patent is subject to a terminal disclaimer.

(21) Appl. No.: 11/965,105

(22) Filed: Dec. 27, 2007

(65) Prior Publication Data

US 2008/0121739 A1 May 29, 2008

Related U.S. Application Data

(63) Continuation of application No. 10/929,963, filed on Aug. 30, 2004, now Pat. No. 7,360,723.

(60) Provisional application No. 60/517,683, filed on Nov. 6, 2003.

(51) Int. Cl.

| | |
|---|---|
| ***B05B 1/18*** | (2006.01) |
| ***B05B 1/14*** | (2006.01) |
| ***B05B 15/08*** | (2006.01) |
| ***B05B 15/06*** | (2006.01) |
| ***A47K 3/022*** | (2006.01) |
| ***A47K 3/28*** | (2006.01) |

(52) U.S. Cl. ..... 239/567; 239/442; 239/443; 239/444; 239/447; 239/449; 239/525; 239/560; 239/587.1; 4/601

(58) Field of Classification Search ..... 239/200, 239/273, 282, 390–392, 394, 397, 436, 437, 239/442–444, 446–449, 525, 548, 550, 556, 239/560, 561, 562, 567, 569, 587.1–587.4, 239/588; 4/567, 601, 605

See application file for complete search history.

(56) References Cited

U.S. PATENT DOCUMENTS

| | | | | |
|---|---|---|---|---|
| 10,919 | A | | 5/1854 | Baldwin |
| 120,555 | A | | 10/1871 | Venn |
| 208,384 | A | | 9/1878 | Furey |
| 550,665 | A | | 12/1895 | Whitcomb et al. |
| 743,623 | A | | 11/1903 | Dinneen |
| 1,893,435 | A | | 1/1933 | Neal |
| 2,949,240 | A | | 8/1960 | Koolnis |
| 2,973,149 | A | | 2/1961 | Kachergis |
| 3,471,872 | A | | 10/1969 | Symmons |
| 3,822,826 | A | | 7/1974 | Wilson |
| 3,971,074 | A | | 7/1976 | Yxfeldt |
| 3,998,390 | A | * | 12/1976 | Peterson et al. ..... 239/394 |
| D267,812 | S | | 2/1983 | Haug |
| 4,749,130 | A | | 6/1988 | Utzinger |

(Continued)

*Primary Examiner*—Darren W Gorman
(74) *Attorney, Agent, or Firm*—Gifford, Krass, Sprinkle, Anderson & Citkowski, P.C.

(57) ABSTRACT

A showerhead system for communicating a fluid supply, the system including a fixed fluid dispensing unit supported at a location, the fixed dispensing unit including a plurality of nozzles in fluid communication with the fluid supply. A removable fluid dispensing unit is releasably secured to a receptacle established within the fixed dispensing, the removable unit further including at least one additional nozzle. The fluid supply is adapted to be in selective communication with either or both the fixed and removable fluid dispensing units, such as through the provision of a fluid diverter element located at an inlet of the fixed unit and from which extends a conduit in separate communication with the removable unit.

15 Claims, 8 Drawing Sheets

U.S. PATENT DOCUMENTS 4,752,975 A 6/1988 Yates
4,778,111 A 10/1988 Leap
4,809,369 A 3/1989 Bowden
4,901,927 A 2/1990 Valdivia
4,975,993 A 12/1990 Black et al.
5,035,010 A 7/1991 Sakamoto et al.
5,073,996 A 12/1991 Schinle
5,121,511 A * 6/1992 Sakamoto et al. ..... 4/601
5,148,556 A 9/1992 Bottoms, Jr. et al.
D342,564 S 12/1993 Jans
5,339,469 A 8/1994 Gilles
D357,972 S 5/1995 Huen et al.
5,564,139 A 10/1996 Shorr
D375,541 S 11/1996 Michaluk
D377,965 S 2/1997 Andrus
D385,616 S 10/1997 Dow et al.
D387,413 S 12/1997 Andrus
5,742,961 A 4/1998 Casperson et al.
5,749,552 A 5/1998 Fan
5,799,346 A 9/1998 Tiernan
D415,246 S 10/1999 Marshall
D415,247 S 10/1999 Haverstraw et al.
D417,482 S 12/1999 Benze
D422,053 S 3/2000 Brenner et al.
6,038,715 A 3/2000 Flieger et al.
D427,661 S 7/2000 Haverstraw et al.
D433,100 S 10/2000 Chan
D434,828 S 12/2000 Ben-Tsur et al.
D434,829 S 12/2000 Ben-Tsur
D435,633 S 12/2000 Ben-Tsur
D435,634 S 12/2000 Ben-Tsur
D435,889 S 1/2001 Ben-Tsur et al.
D435,891 S 1/2001 Raffo
6,223,998 B1 5/2001 Heitzman
D450,370 S 11/2001 Wales et al.
D454,617 S 3/2002 Curbbun et al.
6,415,461 B1 7/2002 Singer
6,446,278 B1 9/2002 Lin et al.
D468,394 S 1/2003 Cummings
D471,953 S 3/2003 Colligan et al.
D472,301 S 3/2003 Mueller et al.
6,550,079 B2 4/2003 Gransow et al.
6,594,832 B2 7/2003 Yang et al.
6,622,947 B1 9/2003 Rivera
D492,004 S 6/2004 Haug et al.
D501,590 S 2/2005 Hall et al.
2003/0041372 A1 3/2003 Yang
2003/0126678 A1 7/2003 Wright et al.

* cited by examiner

SHOWERHEAD SYSTEM WITH INTEGRATED HANDLE

CROSS-REFERENCE TO RELATED APPLICATIONS

This application is a continuation of U.S. patent application Ser. No. 10/929,963 filed Aug. 30, 2004, now U.S. Pat. No. 7,360,723, which claims priority of U.S. Provisional Patent Application No. 60/517,683 filed Nov. 6, 2003.

BACKGROUND OF THE INVENTION

1. Field of the Invention

The present invention generally relates to showerheads. More specifically, the present invention discloses a showerhead incorporating a detachable handle and spray head.

2. Description of the Prior Art

The prior art is well documented with various examples of showerhead attachments and assemblies. In each instance, such showerhead devices provide either or both of a steady stream flow or pulse flow of water to a user, and such as within a shower or tub enclosure. In certain instances, the assembly may be subdivided into more than one water dispensing head, such often including a fixed showerhead and a movable showerhead fluidly related in some fashion to the fixed showerhead.

A first example drawn from the prior art is set forth in U.S. Pat. No. 4,752,975, issued to Yates, and which teaches a showerhead assembly including a diverter valve for diverting a water supply to one of two showerheads. One of the showerheads is generally laterally and adjustably displaced from the other of the showerheads by means of a swivelable extension arm and the entire assembly is easily installable on the existing overhead water supply line of a shower stall or bath enclosure.

U.S. Pat. No. 5,749,552, issued to Fan, teaches a mounting assembly for mounting a bracket for attaching a handheld showerhead in relation to a wall of a bathroom. The mounting assembly includes a fitting having an end for connecting with a fixed spray head, another end for connecting a water supply pipe and an extending portion for threadably engaging a top end of a post on which the bracket can be slidably locked therealong. A bottom end of the post is attached with a vacuum mounting assembly for mounting the bottom end of the post on the wall by a vacuum pressure.

Finally, U.S. Pat. No. 3,471,872, issued to Symmons, teaches a plumbing fixture for baths which facilitates provision of a handheld spray unit in a bathtub or shower installation. A casing incorporates a diverter valve assembly and an ornamental housing which conceals the casing and is adapted to function as a tub spout or as a showerhead support.

In spite of the prior art efforts, there remains a need for a showerhead incorporating a detachable handle and spray head. Such a showerhead would provide flexibility in the water stream characteristics and the shower experience.

SUMMARY OF THE INVENTION

The present invention is a showerhead system for communicating a pressurized water supply. The present invention is an improvement over prior art showerhead systems in that it provides both fixed and interengageable water dispensing units, the fixed unit being supported at a location and comprising a first plurality of nozzles established in a desired contiguous or non-contiguous array. The removable fluid dispensing unit is releasably secured to a receptacle formed within the body of the fixed unit and provides at least one additional, and preferably a plurality of, fluid dispensing nozzle.

The fluid (water) supply is established in selective communication with either or both the fixed and removable dispensing units and such further includes a hose extending from a fluid inlet associated with the fixed dispensing unit and which extends to an inlet end of the removable dispensing unit. A fluid diverter element fluidly communicates the fluid supply with either the fixed dispensing element or, if so adjusted, with only the removable dispensing element via the hose or further with both the fixed and removable dispensing units. The fixed dispensing unit may further include an articulated joint configured intermediate the nozzle and fluid supply and the fixed dispensing unit further includes at least one gripping location to permit readjustment of the fixed unit about the articulating joint.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF TEE PREFERRED EMBODIMENTS

The present invention has utility as a bathroom shower fixture. An inventive showerhead system includes a fixed fluid dispensing unit and a removable fluid dispensing unit releasably secured to a receptacle therefor associated with the fixed dispensing unit such that the fixed dispensing unit and removable dispensing unit in a secured relationship form an integral dispensing face. A fluid supply provides selective communication with at least one of the fixed and removable fluid dispensing units.

Figure 1:
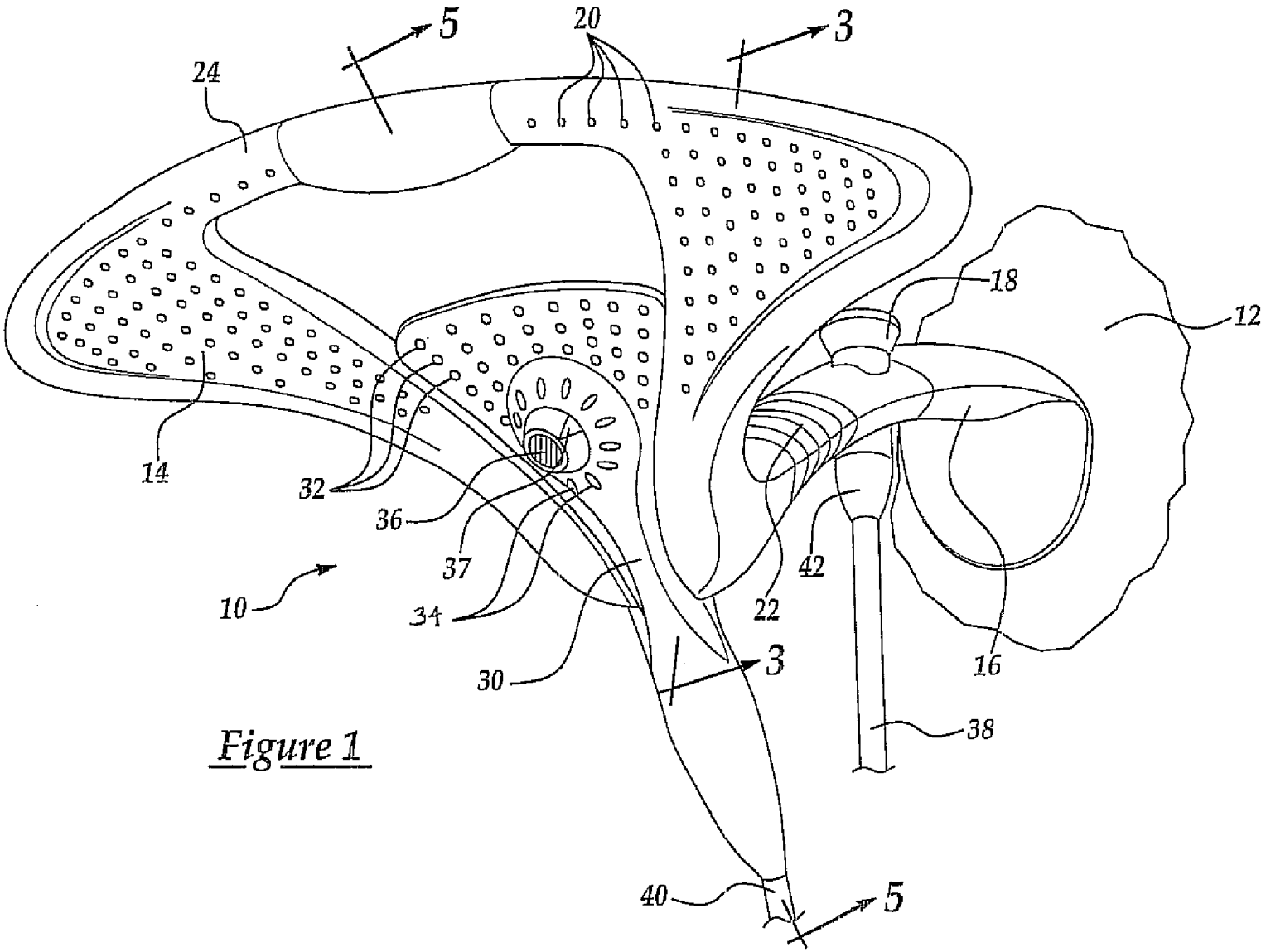
FIG. 1 is a perspective view of a showerhead assembly according to the present invention having a central removable unit.

Referring to FIG. 1, an illustration is shown at 10 of a showerhead assembly and such as which is mounted to a fixed vertical location 12, such as which is typically associated with a shower enclosure or wall surface associated with a bathtub. As previously described, the present invention provides the user with a traditional showerhead experience, additional to the option of removing and manipulating a removable shower handle incorporated into the showerhead. According to the present invention, and as will be further described, the handle optionally functions independently from the head as a water source, or in combination therewith, for the handle and showerhead in their assembled position and dissociated positions, respectively.

Referring again to FIG. 1, the showerhead system includes a fixed fluid dispensing unit 14 which is supported at a location 12. The location 12 illustratively includes a vertical or wall surface, or a Roman tub edge. The fixed dispensing unit 14 includes an inlet end 16, such further including an internal passageway for communicating a fluid flow, such as originating from a pipe or tubing extending in communication with the inlet end.

A fluid diverter element 18, such as a valve, "T" connector or other suitable directional flow control element, is located in fluid communication with the inlet fluid supply and a flow outlet associated with the fixed dispensing element 14. As will be further described, the fluid diverter 18 facilitates selective or combined fluid flow to either or both of fixed and removable fluid dispensing units associated with the showerhead system 10.

A plurality of fluid dispensing nozzles 20 are formed along a face of the fixed dispensing unit 14 and are further understood to be provided in either a contiguous or non-contiguous array pattern. It is further understood and envisioned that the dispensing nozzles 20 are optionally formed in any desired pattern or arrangement, and can also be provided in different sizes and spray dispersion patterns within the skill of one in the ordinary art.

The head of the fixed dispensing unit 14 is optionally further repositioned by virtue of an articulating joint 22 located intermediate between the fluid supply inlet 16 and the array of dispensing nozzles 20. The articulating joint 22 is appreciated to be any conventional adjustment mechanism known to the art, such as a ball joint type or other means of adjustment that affords the ability to tilt and/or rotate the inventive showerhead. As is also best again shown in exploded fashion in FIG. 2, the articulated joint 22 preferably includes an assembly of fittings and elements to facilitate attachment at one end to a fitting 23 associated with the fluid diverter 18 and, at another end, to a fitting 25 associated with the fixed dispensing head 14.

A gripping location, see rear edge 24, facilitates repositioning of the head associated with the fixed unit 14 and about the articulated joint 22. It is also appreciated that a variety of head configurations are operative in the present invention, these configurations illustratively including multiple nozzles in one contiguous pattern such as a ring, arc, rail and a parabola; and a single nozzle forming a circular or linear opening to create a spray or waterfall-type discharge.

Figure 2:
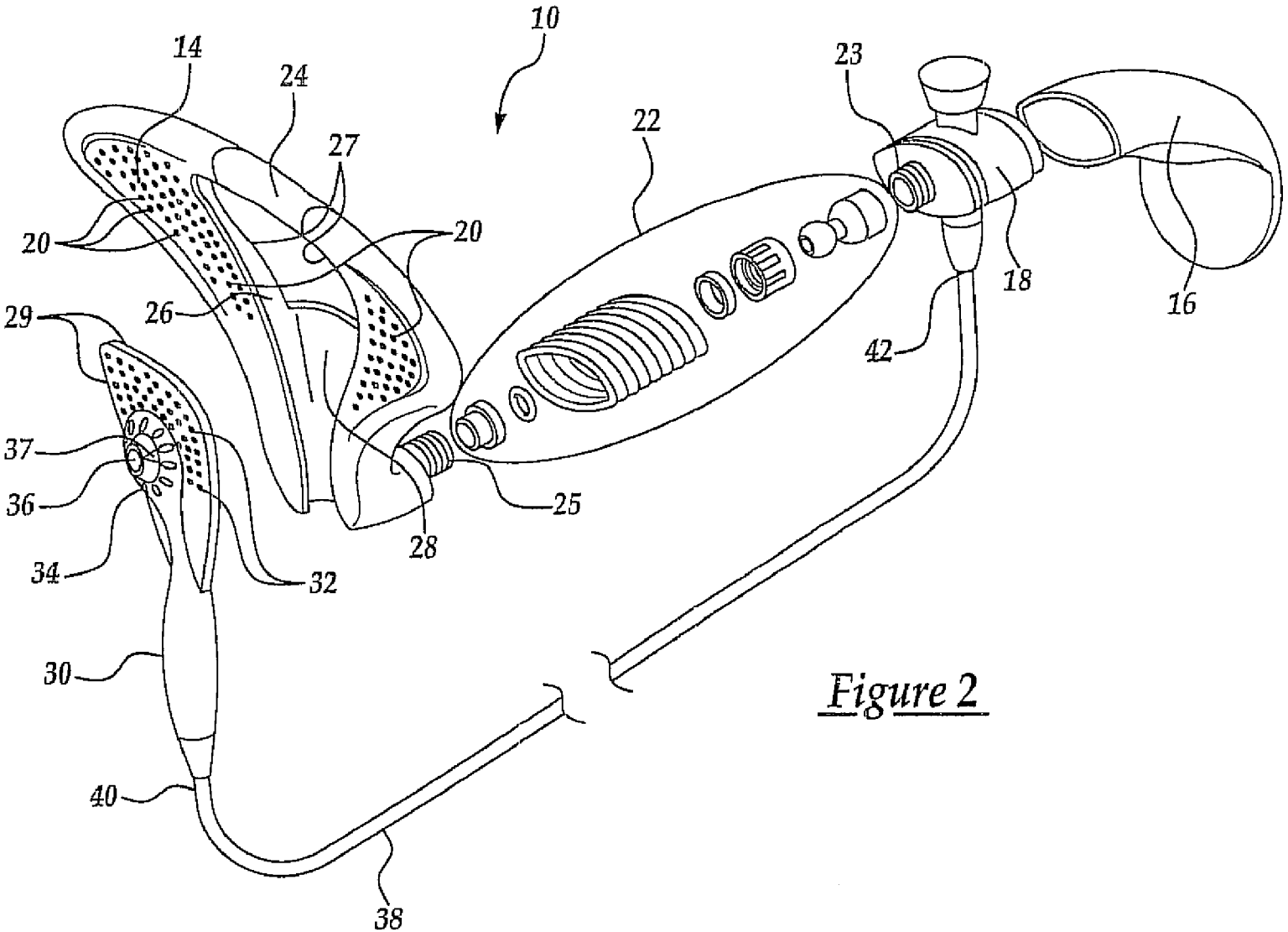
FIG. 2 is an exploded view of the showerhead assembly depicted in FIG. 1.

As is best illustrated in the exploded view of FIG. 2, a receptacle is formed within the fluid dispensing head associated with the fixed unit and is illustrated by recessed side 26 and base surface 28. In a preferred embodiment, the receptacle surfaces are formed along an axial centerline associated with the fixed dispensing head; however it is understood that the receptacle may also be formed in a side-by-side arrangement or other asymmetric fashion relative to the fixed head, as illustratively depicted with respect to FIGS. 6-8.

Figure 5:
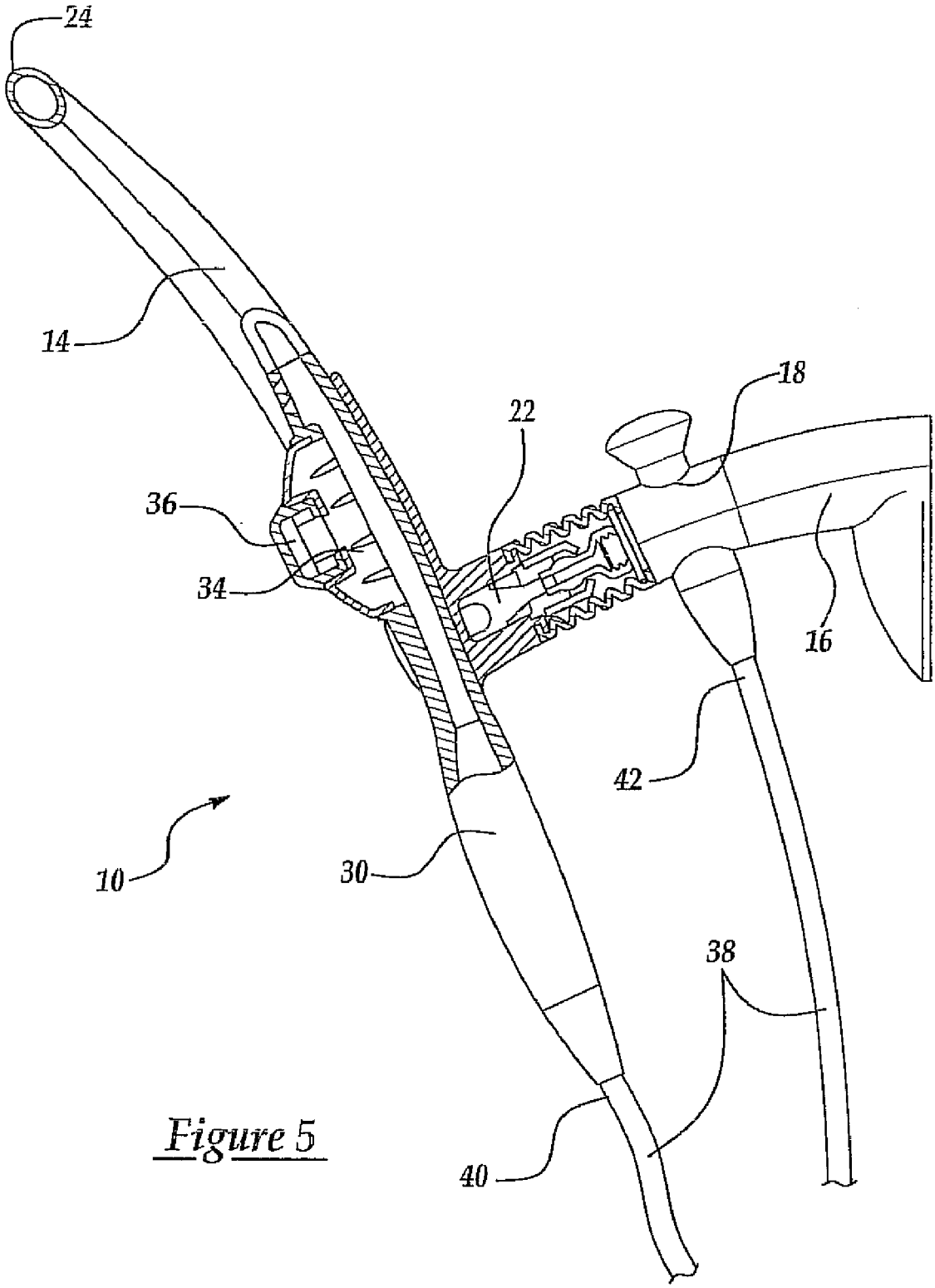
FIG. 5 is a cross-sectional view taken along line 5-5 of FIG. 1 and illustrating a second and centerline cutaway of the showerhead assembly.

Referring again to FIGS. 1, 2 and 5, a removable fluid dispensing unit is illustrated at 30 and, as best again illustrated in FIG. 2, includes a body exhibiting a backside configuration, and such that it may be mechanically and releasably secured within the side 26 and base recessed surface 28 formed in the fixed dispensing unit 14. As again is best shown in FIG. 2, an apertured cutout, see inner walls 27, is formed in the fixed dispensing unit 14 and seats an associated outer perimeter 29 of the removable dispensing unit 30 upon the same being mounted within the recessed side 26 and base surface 28 of the fixed head.

It is further appreciated that a retaining portion is optionally integrated into the removable dispensing unit 30 or, alternatively, represents complementary securing components that attach to a handle and/or showerhead of an inventive system. It is also envisioned and understood that the removable fluid dispensing unit 30 may be secured to the fixed unit 14 such as through the use of Velcro® (hook and loop) portions, spring-loaded retainer pins, cradles, or other securements consistent with the forces and humidity associated with the showerhead use environment.

The removable unit 30 includes at least one plurality of fluid dispensing nozzles and, in a preferred embodiment, may include a first array of nozzles 32 formed in a planar extending face associated with the removable unit. The array of nozzles 32 are similar to the nozzles 20 which are formed across the face of the fixed unit 14. Preferably, a second array of fluid dispensing nozzles 34 are provided. More preferably, a centrally located nozzle 36 is provided relative to the circular nozzle array 34. Each nozzle array 36 and 34 is established in preferably a non-contiguous pattern and provides a different shape and configuration in order to provide multiple spray function modes associated with the removable fluid dispensing unit illustratively including a variable spray or pulse pattern. A removable unit mode control dial 37 affords mode control for the removable unit 30.

As is again best illustrated with reference to FIG. 2, the removable fluid dispensing unit 30 is connected to the water supply through a conduit 38, such as a hose, or other means of conducting the water. One end of the hose 40 is connected to the removable unit 30 and an opposite end 42 is connected to the diverter or T connection 18. As previously described, the head associated with the fixed dispensing unit 14 is optionally connected to the water supply and/or to the inlet 16 through the diverter 18 and it is contemplated that the diverter valve may include up to three flow adjustment positions to facilitate selective or combined fluid flow through the fixed and/or removable dispensing units. In case of a T connection type with no diverting feature, the water is supplied to the removable and fixed dispensing units at all times.

Figure 3:
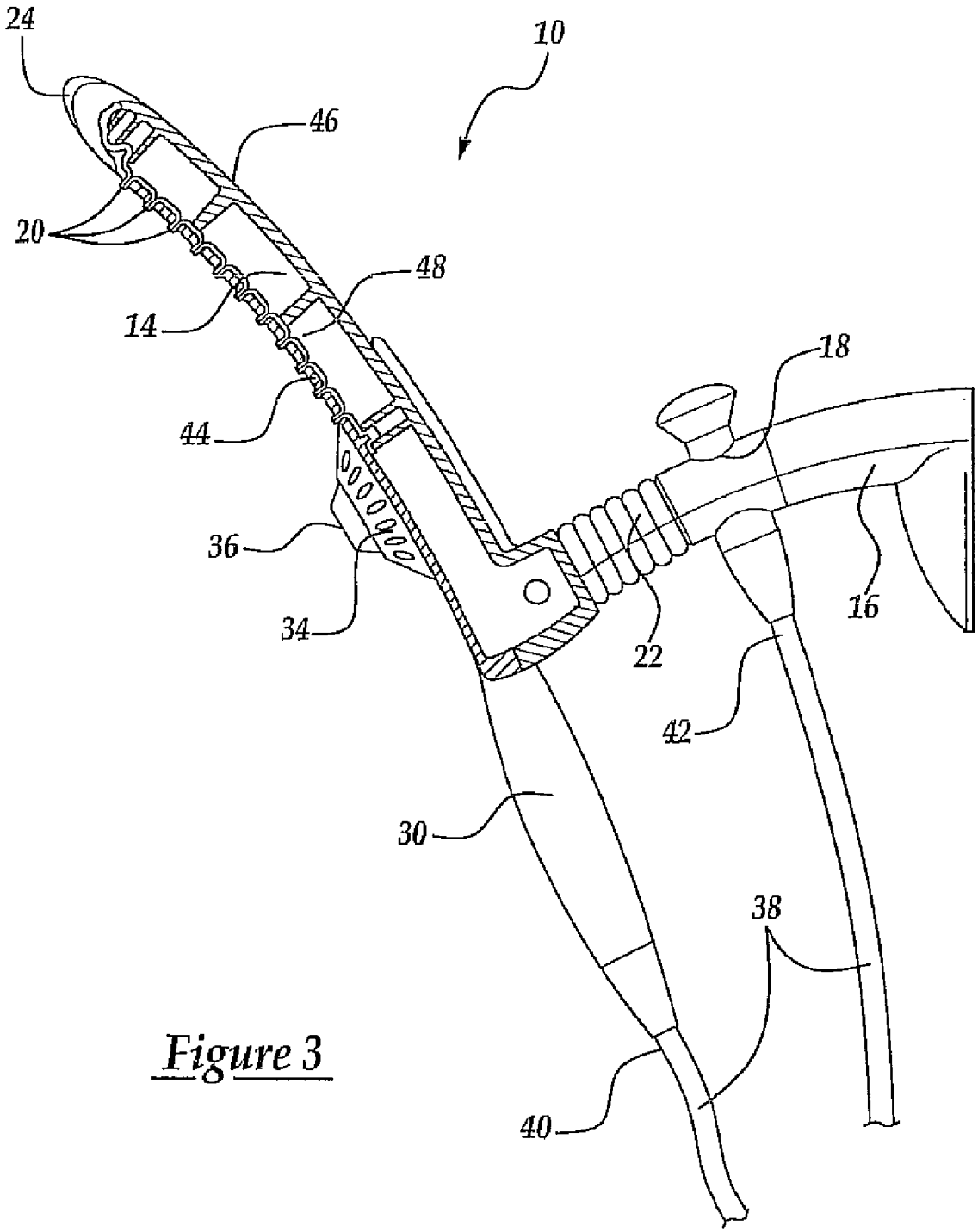
FIG. 3 is a cross-sectional view taken along line 3-3 of FIG. 1 and illustrating a first cutaway of a mounted portion of the showerhead assembly.
Figure 4:
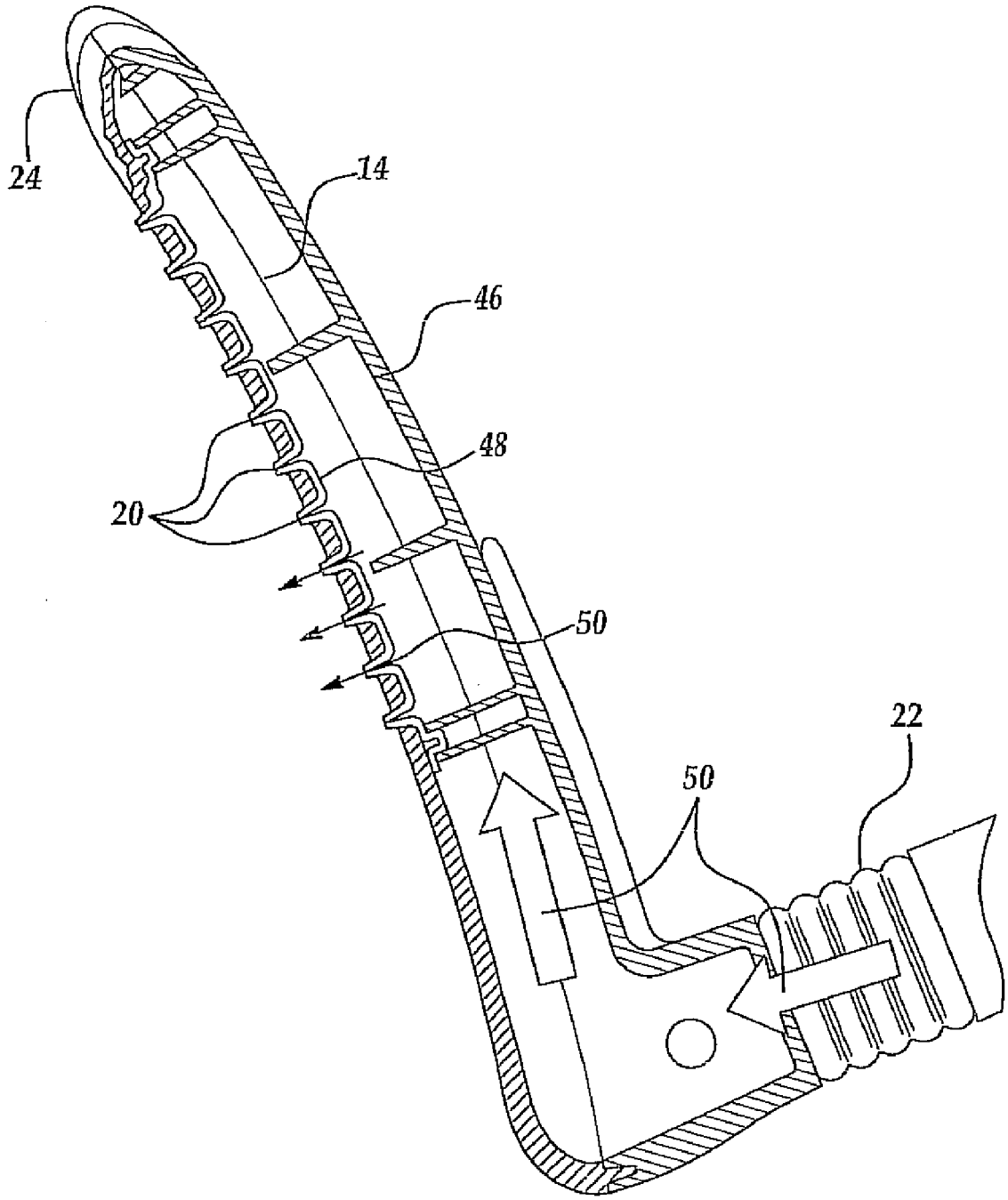
FIG. 4 is a magnified view of the cutaway illustration depicted in FIG. 3.

Referring to FIG. 3, a cross section is shown through the fixed dispensing head 14, which shows the head bottom part 44 and the head top part 46, which are assembled together. The head bottom part 44 further exhibits a series of holes that accommodate the nozzles 20. A nozzle plate 48 is located between the two assemblable halves, directing a water flow 50, see FIG. 4, to different body areas at different angles. In an alternate variant, the nozzle plates 46 and 48 are not used, and in this case the holes in the head bottom part 44 are provided with the nozzle function. The centerline sectional cutaway of FIG. 5 further shows the assembled interaction between the removable unit 30, the head associated with the fixed unit 30, and the articulating/joint assembly 22.

Figure 6:
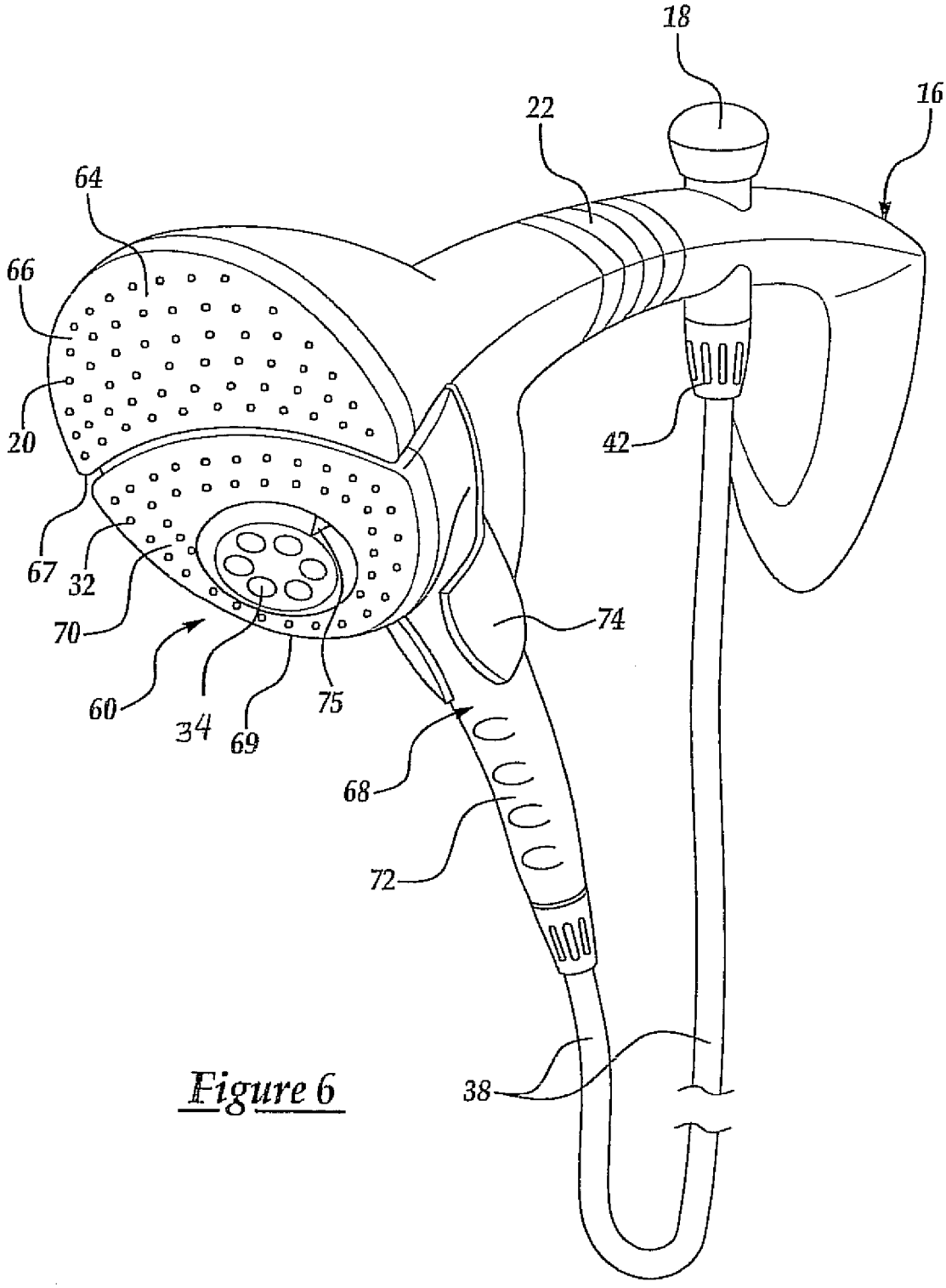
FIG. 6 is a perspective view of a showerhead assembly according to the present invention having a basal removable unit.

Referring now to FIG. 6, a perspective view of an inventive showerhead assembly with an alternate configuration is shown generally at 60 where like numerals correspond to those previously described with respect to preceding FIGS. 1-5. A fixed dispensing head 64 includes multiple nozzles 20 to define a spray face 66. The nozzles 20 are in fluid communication with the inlet 16 by way of the diverter 18 and the joint assembly 22. A recess 67 is adapted to receive a removable fluid dispensing unit 68 therein. The removable dispensing unit 68 has a spray head 69 including fluid dispensing nozzles 32 forming a spray face 70, the face 70 continuous with fixed spray face 66. The removable unit spray head 69 tapers to a handle 72 and is retained in position relative to the fixed dispensing head unit 64 by way of a holster 74. It is appreciated that a removable third dispensing head unit 69 is retained within a holster 74 through modes illustratively including friction fit and snap fit. Preferably, a second array of fluid dispensing nozzles 34 are provided in the removable head unit 69. When a second array of fluid dispensing nozzles 34 are present, it is preferred that a removable unit face dial 75 is present to afford mode control for the removable unit 69.

Figure 7:
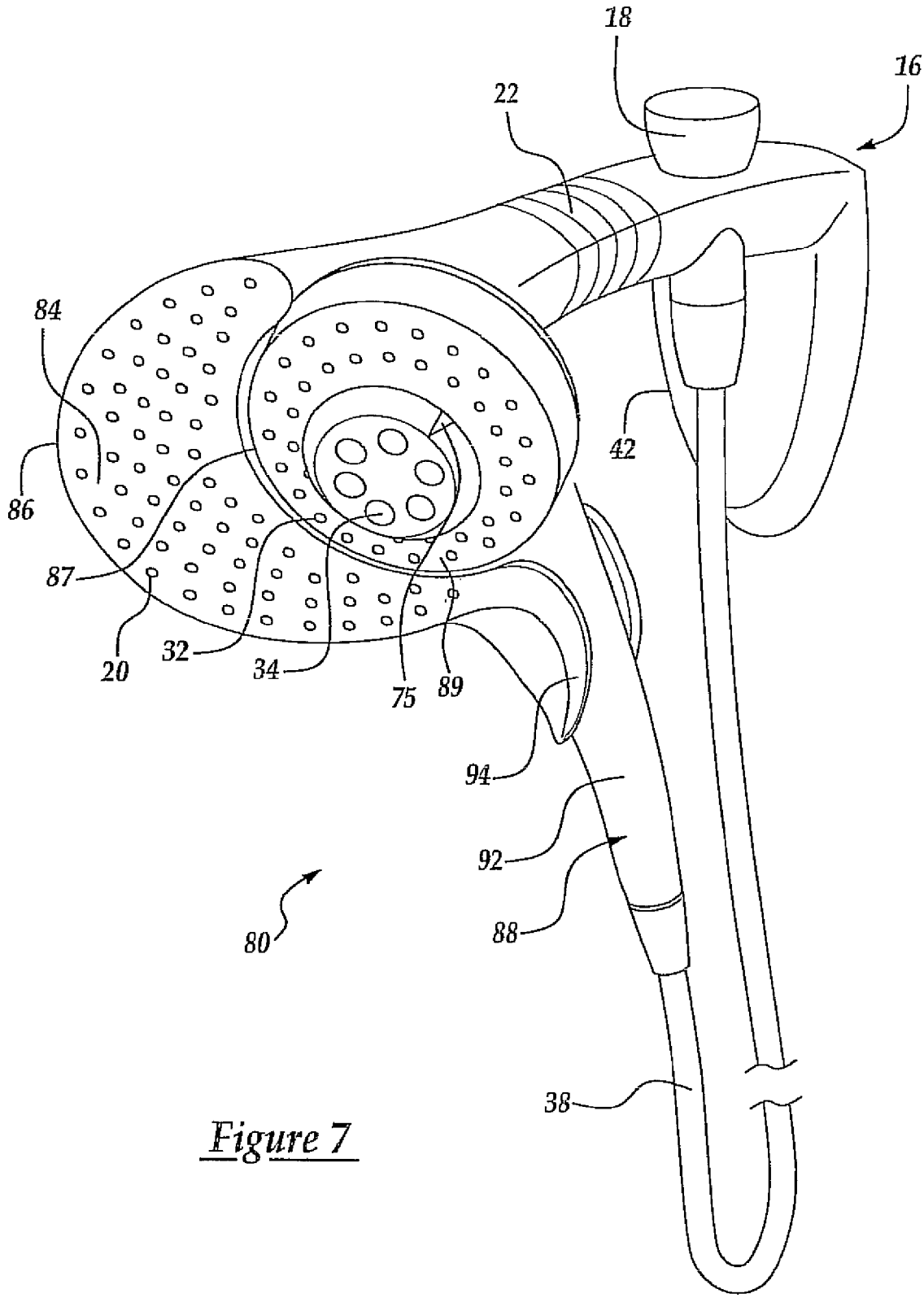
FIG. 7 is a perspective view of a showerhead assembly according to the present invention having a lateral removable unit.

Referring now to FIG. 7, an inventive lateral shower head assembly is shown generally at 80 where like numerals correspond to those detailed previously with respect to FIGS. 1-6. A fixed dispensing head unit 84 has an array of first nozzles 20 defining a spray face 86. Laterally adjacent to the spray face 86 is a recess 87 adapted to receive a removable fluid dispensing head unit 88 having a head 89 that tapers to a handle 92, the nozzles 32 and 34 being in fluid communication with the water inlet 16 by way of hose 38. The fixed fluid dispensing unit 84 is convoluted to form a holster 94 adapted to engage the removable unit 88 intermediate between the head 89 and the handle 92. The holster 94 is secured to the removable unit 88 by a mode illustratively including pressure fit and snap fit. A removable unit face dial 75 affords mode control for water dispensation therefrom.

Figure 8:
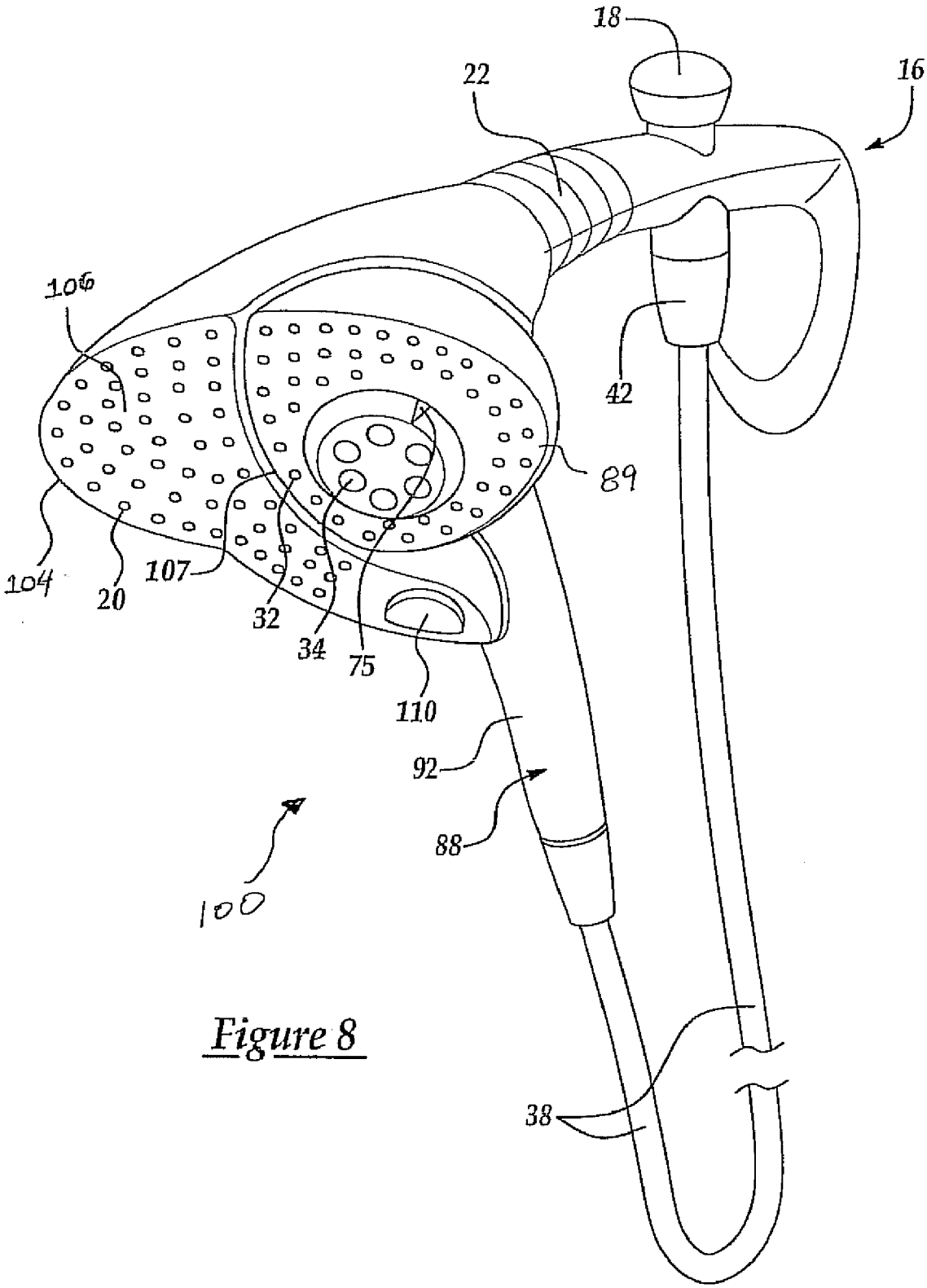
FIG. 8 is a perspective view of a showerhead assembly according to the present invention having an embodiment of a lateral removable unit.

Referring now to FIG. 8, a securement variant for retaining a removable fluid dispensing unit to a fixed dispensing unit is shown generally at 100 where like numerals correspond to those detailed previously with respect to FIGS. 1-7. A fixed dispensing head unit 104 has an array of first nozzles 20 defining a spray face 106. Laterally adjacent to the spray face 106 is a recess 107 adapted to receive a removable fluid dispensing head unit 88 having a head 89 that tapers to a handle 92 with the nozzles 32 and 34 being in fluid communication with the water inlet 16 by way of hose 38. The fixed fluid dispensing unit 104 is convoluted to form a holster 94 adapted to engage the removable unit 88 intermediate between the head 89 and the handle 92. The holster 94 secures the removable unit 88 by a mode illustratively including pressure fit and snap fit. A removable unit face dial 75 affords mode control for water dispensation therefrom.

The removable fluid dispensing unit 88 is retained in contact with the fixed unit 104 to form an integral spray face with 106 through a spring-loaded button 110 extended from the fixed unit spray face 106. A spring-loaded pin that extends from the fixed unit 104 into a complementary indentation in the handle 92 retains the removable unit 88 in position. Depression of the button 110 retracts the pin (not shown) allowing for detachment of the removable unit 88. Replacement of the removable unit 88 depresses the pin which again seats within a complementary indentation in the handle 92. It is appreciated that alternate modes of retaining a removable portion in selective engagement with the fixed portion are known to the art and illustratively include a hinge-pin, male-female, luer, and bayonet fittings.

The preceding figures and description illustrate the general principles of the present invention and some specific embodiments thereof. These are not intended to be a limitation upon the practice of the present invention since numerous modifications and variations will be readily apparent to one skilled in the art upon consideration of the drawings and description. The following claims, including all equivalents thereof, are intended to define the scope of the invention.

What is claimed is:

1. A showerhead system for communicating with a fluid supply, said showerhead system comprising:

a fixed fluid dispensing unit supported at a location, said fixed dispensing unit having a recessed side adjacent to a base recessed surface defining a receptacle comprising a plurality of nozzles defining a fixed fluid dispensing surface in fluid communication with the fluid supply; and a removable fluid dispensing unit having a head that tapers to a handle, said removable fluid dispensing unit releasably secured to engage the base recessed surface of the receptacle of said fixed dispensing unit, a side of the head complementary to the recessed side of said fixed fluid dispensing unit, said removable fluid dispensing unit and comprising an array of removable fluid dispensing unit nozzles, said removable fluid dispensing unit connected to a hose, said hose in fluid communication with the fluid supply, such that when said removable fluid dispensing unit is dissociated from said fixed fluid dispensing unit, said removable fluid dispensing unit remains connected with the fluid supply via said hose.

2. The showerhead system as described in claim 1 wherein said fluid supply is adapted to being in selective communication with at least one of said fixed fluid dispensing unit and said removable fluid dispensing unit.

3. The showerhead system as described in claim 1, wherein said plurality of nozzles associated with said fixed fluid dispensing unit are located contiguous to one another.

4. The showerhead system as described in claim 1, wherein the base recessed surface extends along a substantial centerline associated with said fixed fluid dispensing unit.

5. The showerhead system as described in claim 1 further comprising a holster affixed to said fixed fluid dispensing unit, said holster adapted to engage said removable unit.

6. The showerhead system as described in claim 5 wherein said removable unit is laterally displaced relative to said fixed fluid dispensing unit.

7. The showerhead system as described in claim 5 wherein said removable unit is basally displaced relative to said fixed fluid dispensing unit.

8. The showerhead system as described in claim 1, further comprising a fluid inlet associated with said fixed dispensing unit, a fluid diverter element fluidly communicating said fluid supply with at least one of said fixed fluid dispensing unit and said removable fluid dispensing unit.

9. The showerhead system as described in claim 1 further comprising an articulating joint intermediate between said fixed dispensing unit and the fluid supply.

10. The showerhead system as described in claim 1, wherein said removable fluid dispensing unit has a plurality of spray function modes.

11. The showerhead system as described in claim 10 further comprising at least one additional nozzle in said removable fluid dispensing unit and a mode control dial controlling flow between the at least one additional nozzle and the fluid supply.

12. The showerhead system as described in claim 10 wherein said fixed fluid dispensing unit further comprises at least one gripping location to permit readjustment of said fixed unit about an articulating joint.

13. A showerhead system for communicating with a fluid supply, said showerhead system comprising:

a fixed fluid dispensing unit supported at a location, said fixed dispensing unit having a recessed side adjacent to a base recessed surface defining a receptacle comprising a plurality of nozzles defining a fixed fluid dispensing surface in fluid communication with the fluid supply, said fixed fluid dispensing unit selectively creating a first fluid spray pattern; and a removable fluid dispensing unit having a head that tapers to a handle, said removable fluid dispensing unit releasably secured to engage the base recessed surface of the receptacle of said fixed dispensing unit, a side of the head complementary to the recessed side of said fixed fluid dispensing unit, said removable fluid dispensing unit comprising an array of removable fluid dispensing unit nozzles, said removable fluid dispensing unit connected to a hose, said hose in fluid communication with the fluid supply, such that when said removable fluid dispensing unit is dissociated from said fixed fluid dispensing unit, said removable fluid dispensing unit remains connected with the fluid supply via said hose, said array of removable fluid dispensing unit nozzles selectively creating a second fluid spray pattern at least partially intersecting said first fluid spray pattern when said removable fluid dispensing unit is secured to said receptacle of said fixed dispensing unit.

14. The showerhead system as described in claim 13 wherein said fluid supply is in selective communication with at least one of said fixed and removable fluid dispensing unit.

15. The showerhead system as described in claim 13, wherein said removable dispensing unit has a plurality of spray function modes.

* * * * *